United States Patent [19]

Cannon

[11] 4,238,871

[45] Dec. 16, 1980

[54] SLIDE FASTENER INSTALLATION

[75] Inventor: Robert E. Cannon, Meadville, Pa.

[73] Assignee: Textron, Inc., Providence, R.I.

[21] Appl. No.: 907,633

[22] Filed: May 19, 1978

[51] Int. Cl.[2] ..... A44B 19/00

[52] U.S. Cl. ..... 24/205.11 R; 5/413; 24/205.11 F

[58] Field of Search ..... 5/343, 449, 413; 2/69.5; 24/205 R, 205.11 R, 205.11 F

[56] References Cited

U.S. PATENT DOCUMENTS

| | | | |
|---|---|---|---|
| 2,378,719 | 6/1945 | Morin | 24/205 R |
| 2,519,012 | 8/1950 | Babcock | 24/205 |
| 2,784,473 | 3/1957 | Morin | 24/205 R |
| 2,972,757 | 2/1961 | Adrian | 5/343 |
| 3,331,107 | 7/1967 | Connolly et al. | 24/205.11 R |
| 3,456,305 | 7/1969 | Voit | 24/205.11 R |
| 3,490,970 | 1/1970 | Heimberger | 24/205.11 F X |
| 3,530,549 | 9/1970 | Manchester, Jr. | 24/205.11 R X |
| 3,533,140 | 10/1970 | Waldes | 24/205 R |
| 3,845,526 | 11/1974 | Kawakami | 24/205.11 R X |
| 3,900,926 | 8/1975 | Takahashi et al. | 24/205 R |

*Primary Examiner*—Philip C. Kannan
*Attorney, Agent, or Firm*—O'Brien & Marks

[57] ABSTRACT

A slide fastener installation is disclosed for use in a sleeping bag, jacket or other article. The slide fastener installation is formed from one continuous slide fastener stringer and one end of the installation is formed by that stringer being looped back on itself. A separating end stop is formed at the other end of the installation and includes a separating end device formed by removing the head portion from a series of coupling elements.

12 Claims, 12 Drawing Figures

SLIDE FASTENER INSTALLATION

BACKGROUND OF THE INVENTION

1. Field of the Invention

The present invention relates to slide fasteners and, in particular, to such fasteners which are separating at one end for use in jackets, sleeping bags, or other articles.

2. Description of the Prior Art

The prior art does contain examples of slide fastener installations including a pair of stringer sections formed of one continuous stringer. Examples of such devices are shown in U.S. Pat. Nos. 2,378,719, 2,638,650 and 2,784,473. It has been a problem with such installations that they have not been widely used due to the difficulty and complexity in installing separating end stops in such installations, which would otherwise be very economical. It has also been proposed in at least one instance, as shown in U.S. Pat. No. 2,500,084, to have a releasable slide fastener extend completely around the front opening in a garment.

The prior art is also, of course, generally cognizant of the inclusion of slide fastener installations in sleeping bags. Examples of such sleeping bags are shown in U.S. Pat. Nos. 3,510,889 and 3,639,931. It is a problem in sleeping bags with such installations in that the slide fasteners are often difficult to install and do not in all cases allow similar bags to be fastened together.

At least one example is known of the use of an overlayed sheet of material in forming an end stop in a slide fastener. Such an example is shown in U.S. Pat. No. 4,023,241.

SUMMARY OF THE INVENTION

The present invention is summarized in that a slide fastener includes a pair of stringer tape sections having inner edges supporting coupling elements with a slider for opening and closing the fastener, and a separating end stop including a retaining end stop on one stringer tape section and a separating end device on the other stringer tape section, wherein the separating end device is formed from substantially undeformed severed pairs of leg portions of coupling elements from which the head portions have been removed and with the severed pairs of leg portions being joined and reinforced by a thin thermoplastic film folded over the severed leg portions and bonded to opposite sides of the stringer tape section.

It is an object of the present invention to construct a slide fastener installation from a single stringer that is economical and easy to install and yet is durable and secure.

It is another object of the present invention to provide such a slide fastener installation that is suitable for installation in a wide variety of articles.

It is yet another object of the invention to construct such a slide fastener installation in which the end stops are constructed using as few additional parts and manufacturing steps as is possible.

Yet other objects, advantages and features of the present invention will become apparent from the following specification when taken in conjunction with the accompanying drawings.

DESCRIPTION OF THE PREFERRED EMBODIMENT

Figure 1:
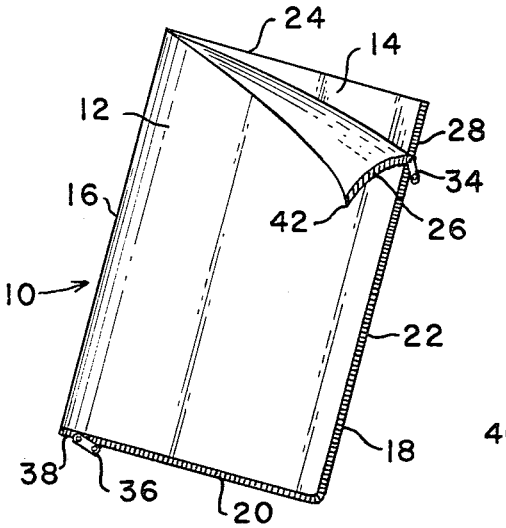
FIG. 1 is a plan elevation view of a sleeping bag including therein a slide fastener installation constructed according to the present invention.

Shown in FIG. 1 is a sleeping bag, generally indicated at 10, including therein a slide fastener installation constructed in accordance with the present invention. The sleeping bag 10 has a closable opening formed between an upper half 12 and a lower half 14 each formed of two layers of lining material having a quantity of insulating material such as fiberfill, down or cotton fiber between them. The two bag halves 12 and 14 are integrally joined together along a common one of their two longitudinal sides, the common longitudinal side edge being designated by the reference numeral 16. An opposite longitudinal side edge 18 and a bottom edge 20 of the two bag halves 12 and 14 define a closable opening into which is installed a slide fastener installation 22. A top edge 24 of the bag may also be closable by a draw string, closure flap, or similar device.

The slide fastener installation 22 includes a pair of slide fastener stringers 26 and 28 which are attached to the edges of the bag halves 12 and 14 respectively. Each of the stringer sections 26 and 28 extends over the full opposite longitudinal edge 18 and the bottom edge 20 of the respective bag half. Each of the stringer sections 26 and 28 includes a mounting tape 30 which is secured to the edge of the respective bag half 12 or 14 along its edges and which has a series of spaced molded thermoplastic coupling elements 32 mounted on its other edge. The coupling elements 32, which may be molded on connecting threads which are then attached to the mounting tape 30, or which may be molded directly onto the edge of the mounting tape 30, are designed to be symmetrical so that they may be oriented in either direction and still correctly interengage with the coupling elements 32 of the opposite stringer section. A pair of sliders 34 and 36 are entrained on the slider sections 26 and 28 and are movable in either direction along the stringer sections 26 and 28 to selectively open and close the slide fastener installation 22. The sliders 34 and 36 are oriented in opposite directions so that the sliders selectively open and close the slide fastener installation 22 from opposite ends thereof.

Figure 2:
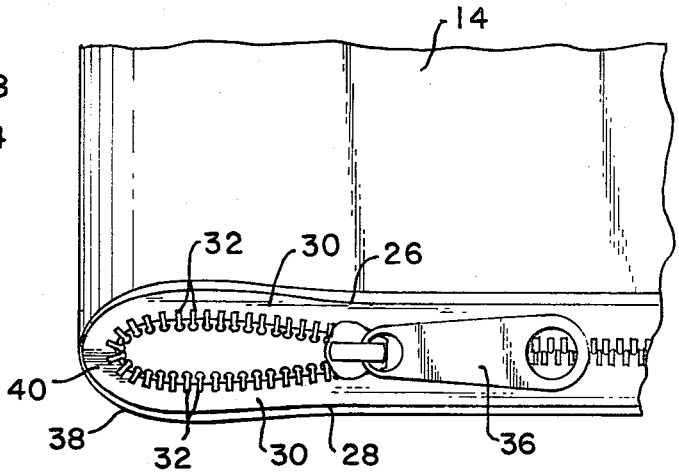
FIG. 2 is an enlarged plan view of the bottom end stop of the slide fastener installation in the sleeping bag of FIG. 1.

At the end of the bottom edge 20 of the bag 10, adjacent the common longitudinal edge 16, the slide fastener installation 22 is terminated by a bottom end stop 38, shown in greater detail in FIG. 2. The bottom end stop 38 is formed by a looped-back portion 40 of slide fastener stringer. The looped-back portion 40 is formed since the stringer sections 26 and 28 are, in fact, formed by one continuous slide fastener stringer which is continuously sewn to each of the opposite longitudinal side edge 18 of the bag half 12 the bottom edge 20 of the bag half 12, the bottom edge 20 of the bag half 14, and opposite longitudinal side edge 18 of the bag half 14. The looped-back portion 40 is the continuous connection between the two parts, the stringer sections 26 and 28 of the continuous stringer.

Figure 3:
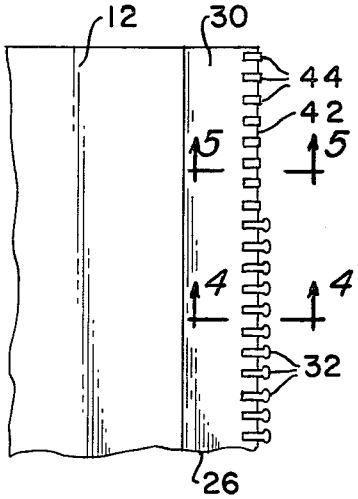
FIG. 3 is an enlarged plan view of the separating top device of the slide fastener installation in the sleeping bag of FIG. 1.
Figure 4:
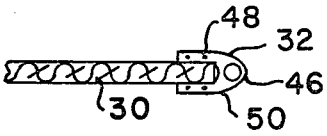
FIG. 4 is a cross-section along the line 4—4 in FIG. 3.
Figure 5:
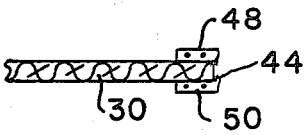
FIG. 5 is a cross-section along the line 5—5 in FIG. 3.

At the extreme upper end of the opposite longitudinal side edge 18 of the bag 10 there is formed a separating top device 42 which terminates the upper end of the stringer section 26. As shown in FIG. 3, this separating top device 42 is formed by a series of coupling elements 32 having their head portions cut off to form deformed elements 44. As can be seen in FIG. 4, the coupling elements 32 are normally formed with a symmetrical head portion 46 from which a pair of legs 48 and 50 depend on opposite sides of the edge of the mounting tape 30 on which they are mounted. Shown in FIG. 5 is a deformed element 44 which has had the head portion 46 removed, as by mechanical cutting, leaving the legs 48 and 50 attached to the edge of the mounting tape 30. A sufficient number of the deformed elements 44 are formed at the top end of the stringer section 26 such that the separating top device 42 formed by the deformed elements 44 is just slightly longer than the combined length of the bodies of the two sliders 34 and 36.

Figure 6:
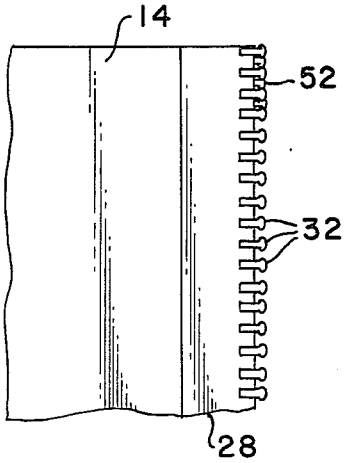
FIG. 6 is an enlarged plan view of the retaining top stop of the slide fastener installation in the sleeping bag of FIG. 7.
Figure 7:
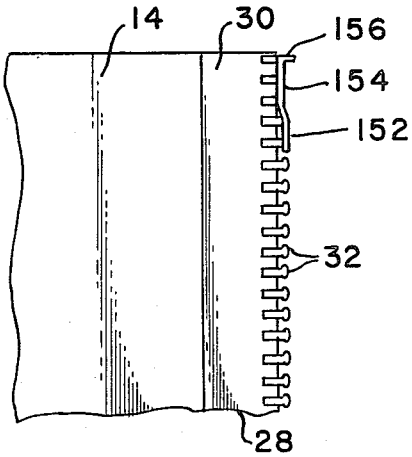
FIG. 7 is an enlarged plan view of an alternative embodiment of the retaining top stop of FIG. 6.

At the top end of the stringer section 28 at the extreme top edge of its opposite longitudinal side edge 18, as shown in FIG. 6, a retaining top stop 52 is formed. The retaining top stop 52 is formed by an end portion of the stringer section 28 being folded over and sewn to itself. An alternative embodiment of the retaining top stop, designated 152, is shown in FIG. 7. The retaining top stop 152 is formed by a length of plastic material forming a stiff pin 154 which is secured to and over the coupling elements 32 at the end of the stringer section 28. An enlarged retaining knob 156 is formed at the extreme upper end of the pin 154.

In its operation the sleeping bag 10 functions as any conventional sleeping bag. However, the operation of the slide fastener installation 22 offers several significant advantages over the prior art, particularly in view of its low cost of manufacture.

Since the sliders 34 and 36 are oriented in opposite directions, they function to open and close the closure of the slide fastener installation 22 from opposite ends thereof. The slider 36 closes the bag halves 12 and 14 together as it moves toward the bottom end stop 38 and opens the closure as it moves in the opposite direction. The slider 34 closes together the stringer sections 26 and 28 as it moves toward the top end of the slide fastener 22 while it opens them as it moves in the other direction. The slide fastener installation 22 is completely closed when the sliders 34 and 36 are at opposite ends while it opened when they are at the same end of the slide fastener.

The bottom end stop 38 is formed so as to be an effective end stop for the sliders 34 and 36 without requiring additional materials or devices. The slider 36, as it moves to the left in FIG. 2, simply runs out of coupling elements 32 as it reaches the looped-back portion 40 and can be moved no further. By making the stringer sections 26 and 28 a part of one continuous stringer, the need for stocking different size stringers in the plant for manufacturing the bags 10 is also obviated. The stringer is simply supplied in a continuous reel and is cut off at the desired point after being sewn around the respective opening in each bag. Thus the construction of the bottom end stop 38 not only forms an effective stop at the end of the slide fastener installation 22, but also allows greater simplicity and standardization of manufacture within the factory of the bag manufacturer.

The separating top device 42 is similarly designed to get maximum usefulness at a minimum cost. When both the sliders 34 and 36 are moved to the top of the slide fastener 22, the separating top device 42 can be slid out from the sliders 34 and 36 to completely separate the ends of the stringer sections 26 and 28 to allow the bag 10 to be swung open with the halves 12 and 14 being folded flat. The sliders 34 and 36 are retained on the retaining top stop 52 by the folded back portion of the stringer section 28. If the alternative retaining top stop 152 is used, the sliders 34 and 36 are received on the pin 154 and are retained thereon by the retaining knob 156 over which they cannot pass.

With the bag halves 12 and 14 folded flat, the bag 10 can be attached to a similar bag 10 with no additional fastenings needed. This is a desirable feature in all sleeping bags. The sliders 34 and 36 at the retaining top stop 52 of the two bags simply have the separating top devices 42 of the other bag slid into them with the sliders 36 then being pulled downward until they meet near the bottom end stops 38. Thus provision is made easily and economically in the bag 10 for joining similar bags together to form a continuous larger bag.

Note that in the slide fastener installation 22, the symmetry of the coupling elements 32 is a key importance. Since the stringer sections 26 and 28 are oriented in opposite directions, the coupling elements 32 must be symmetrical so that they will interengage with similar coupling elements oriented in an opposite direction.

Conventional separating slide fastener installations include at one end a separating stop including a pin side and a retaining stop side. In separating such a slide fastener, the slider or sliders are pulled up abutting the retaining stop side and the pin side is withdrawn from within the slider or sliders. The pin side can then be re-inserted in the slide or sliders to allow reclosure of the slide fastener. In the slide fastener installation 22 as shown in FIGS. 1–6, the need for such a pin side has been obviated by the provision for the separating top device 42. Since this top device 42 slides in and out of the sliders 34 and 36, it may function similarly to such a pin side, and yet the top device 42 is created without most of the costly steps normally involved in fabricating such a pin side, such as cleaning off the coupling elements from the pin side area and separately molding such a pin side on the mounting tape. In this way a significant savings in both manufacturing and material expense is made. This economical and novel technique for fabricating a separating end stop is applicable to other articles with closable openings as well.

Figure 8:
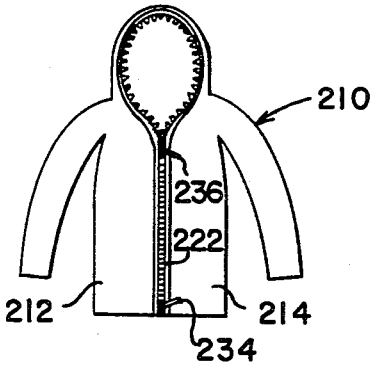
FIG. 8 is a perspective view of a jacket including therein a slide fastener installation constructed according to the present invention.

Shown in FIG. 8 is a jacket, generally indicated at 210 having a slide fastener installation 222 constructed according to the present invention installed therein. The slide fastener 222 is installed in a closable opening in the jacket 210 formed between a pair of sides 212 and 214 of the jacket 200. Each of the jacket sides 212 and 214 has a respective stringer section 226 and 228 attached to its edge, the stringer sections 226 and 228 being formed from one continuous slide fastener stringer sewn to both of the jacket sides 212 and 214. Each of the stringer sections 226 and 228 includes a mounting tape 230 having a series of symmetrical coupling elements 232 formed thereon. A pair of oppositely oriented sliders 234 and 236 are entrained on the stringer sections 226 and 228 for movement thereon.

Figure 9:
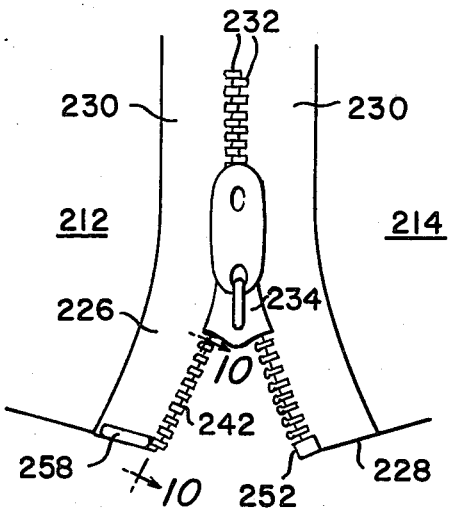
FIG. 9 is an enlarged plan view of the separating end of the slide fastener installation in the jacket of FIG. 8.
Figure 10:
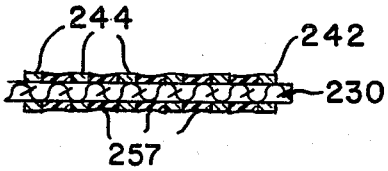
FIG. 10 is a cross-section along the line 10—10 in FIG. 9.

The separating end structure of the slide fastener installation 222 is shown in greater detail in FIG. 9, which shows the slider 234 pulled up a slight distance from the separating end of the fastener. The stringer section 228 terminates in a retaining stop 252, which in this embodiment is formed by a metallic stop clamped over a one of the coupling elements 232 and sized so as to prevent passage of the slider 234 over it. The stringer section 226 has a separating end device 242 formed of a series of coupling elements 232, whicch have their head portions removed in similar fashion to the coupling element 32 of FIGS. 4 and 5, to leave severed leg portions 244. The severed leg portions 244, except for the severing, remain substantially undeformed. A quantity of thermoplastic stiffening material 257 is applied to the stringer section 226 between the severed leg portions 244 on each side of the mounting tape 230, as shown in FIG. 10, to join the severed leg portions and complete the separating end device 242. A reinforcing strip 258 of the stiffening material is also applied a cross a section of the tape 230 at its extreme end in the stringer section 226.

In its operation, the slide fastener installation 222 functions as an inexpensive yet reliable separable fastener for the jacket 210. Movement of the sliders 234 and 236 can open or close the fastener from either its upper or lower end. Since the stringer is looped completely around the neck of the jacket 210, the need for a stop at the end of the slide fastener installation 222 is obviated. The combination of the retaining stop 252 and the end device 242 functions as a separating end stop to that end of the installation. To separate the stringer sections 226 and 228, the sliders 234 and 236 are pulled downwardly until they abut the retaining stop 252. Then the end device 242 can function in the role of a pin side for the separating end, slipping out of and in to the sliders 234 and 236 to separate and re-engage the end of the slide fastener.

A separating end stop is thus obtained in a manner having significant advantages over the prior art. Since the severed leg portions 244 are not removed, no gapping and cleaning operation is required as is required in installing conventional separating end devices. Furthermore, since the severed leg portions 244 are themselves included together with the reinforcing material 257 in the end device 242, a significant savings is achieved in the amount of material that has to be added to complete this pin side. Perhaps the greatest advantage is that since the operations required to fabricate the end device 242 are relatively simple, therefore the device can be fabricated at the point of installation into a garment rather than having to be pre-manufactured in set sizes. This allows for greater flexibility in manufacture and savings in inventory and wastage. It is noted that the outer surfaces of the severed leg portions 244 are exposed and determine the outer dimensions of the device 242 thus not requiring molding steps.

Figure 11:
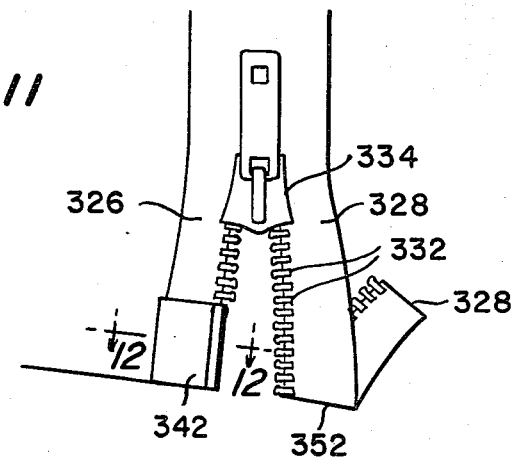
FIG. 11 is a plan view of an alternative embodiment of a separating end for use in a slide fastener installation constructed according to the present invention.
Figure 12:
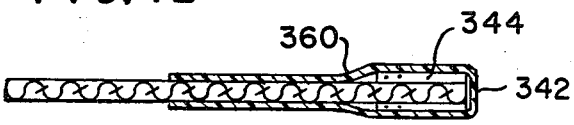
FIG. 12 is a cross-section along the line 12—12 in FIG. 11.

Another embodiment of a separating end stop for a slide fastener, usable in either of the slide fastener installations 22 or 222 of FIGS. 1–10, is shown in FIGS. 11 and 12. The separating end stop includes a pair of stringer sections 326 and 328 each having a plurality of symmetrical coupling elements 332 mounted thereon with a slider 334 entrained on them. A retaining end stop 352 is formed by an end portion of the stringer section 328 which is folded back and sewn on itself. A separating end device 342 is formed at the end of the stringer section 326. The separating end device 342 is formed of a series of severed leg portions 344 having a film 360 secured over it. As shown in the cross-section of FIG. 12, the severed leg portions 344 are formed by a series of coupling elements 332 having their head portions cut from them, similar to the severed leg portions 44 and 244. The film 360 is a sheet of thin thermoplastic material wrapped over the severed leg portions 344 and both sides of the mounting tape. The film 360 is secured in place either by heat-shrinking the film in place or by subjecting the film 360 to an ultrasonic treatment so that it adheres to the mounting tape. The film 360 is selected to be thin enough so that the film does not greatly increase the dimensions of the device 342 and the device 342 easily slips through the slider.

The separating end device of FIGS. 11 and 12 functions similarly to those of FIGS. 1–9. The end device 342 function as a pin side to be slipped into and out of the slider 334 to separate or re-unite the fastener. The provision of the film 360 reinforces the end portion of the tape 326 and severed leg portions 344 to make the end device 342 sturdy and durable while still utilizing the severed leg portions 344 which are not substantially further deformed and which with the tape 326 determine the outer dimensions of the end device 342.

In view of the fact that the present invention is subject to many modifications, variations, and changes in detail, it is intended that all the subject matter in the aforegoing specification or in the accompanying drawings be interpreted as illustrative, and not in a limiting sense.

What is claimed is:

1. A slide fastener comprising a pair of slide fastener stringer tape sections;

a plurality of slide fastener coupling elements mounted on each stringer tape section, each coupling element having a head portion and a pair of legs extending therefrom;

at least one slider entrained on the coupling elements of the two stringer tape sections for movement therealong; and a separating end stop at one end of the slide fastener, the separating end stop including a retaining end stop on one stringer tape section to retain the slider thereon and a separating end device on the other stringer tape section, the separating end device including a plurality of substantially undeformed severed pairs of leg portions of coupling elements from which the head portions have been removed and a thermoplastic film folded over the severed leg portions and bonded to the opposite sides of the other stringer tape section, said thermoplastic film reinforcing the other stringer tape section and severed leg portions and being sufficiently thin to permit movement of the separating end device through the slider.

2. A slide fastener as claimed in claim 1 wherein the retaining end stop is formed by a folded back portion of slide fastener stringer.

3. A slide fastener as claimed in claim 1 wherein the retaining end stop is formed by a metallic stop clamped over a one of the coupling elements.

4. A slide fastener as claimed in claim 1 wherein the film is heat-shrunk to secure it in place.

5. A slide fastener as claimed in claim 1 wherein the film is secured in place by ultrasonic bonding.

6. A slide fastener as claimed in claim 1 wherein there are two sliders oriented in opposite directions so as to open and close the slide fastener from opposite ends thereof.

7. A sleeping bag comprising an upper and a lower bag half, each of generally rectangular shape and filled with an appropriate insulating material, the two bag halves being joined along one common longitudinal edge, a slide fastener stringer section extending along the opposite longitudinal and bottom edge of each of the bag halves, each of the stringer sections including a continuous mounting tape having a series of spaced, symmetrical coupling elements mounted along one edge thereof, a pair of sliders entrained on the two stringer sections, the sliders being oriented in opposite directions to engage and disengage the coupling elements of the stringer sections from opposite directions, and an end stop formed at the end of the bottom edge of the bag adjacent the common longitudinal edge, the stringer sections being each a part of one continuous stringer with the end stop being formed by the one continuous stringer being looped back on itself.

8. A sleeping bag as claimed in claim 7 wherein a top stop is formed at the upper end of the opposite longitudinal edge of the bag, the top stop formed of a separating top device on one stringer section and a retaining top stop formed on the other stringer section.

9. A sleeping bag as claimed in claim 8 wherein each of the coupling elements having a head portion with a pair of legs depending therefrom on opposite sides of the edge of mounting tape, and wherein the separating top device includes a series of deformed elements formed by removing the head portions of a series of coupling elements.

10. A sleeping bag as claimed in claim 9 wherein the separating top device is slightly longer than the length of the two sliders.

11. A sleeping bag as claimed in claim 8 wherein the retaining top stop is formed by the extreme end of the stringer section being folded back on itself.

12. A sleeping bag as claimed in claim 8 wherein the retaining top stop is formed by a pin formed over the tops of a series of coupling elements, the pin having a retaining knob at the end thereof to retain the sliders thereon.

* * * * *